United States Patent [19]

Stone et al.

[11] 4,265,692

[45] May 5, 1981

[54] METHOD FOR PRODUCING TEAR TAPE AND SEAL AND TEAR LINE FOR PACKAGING

[75] Inventors: Arnold F. Stone, Franklin; William D. Kinnard, Spring Hill, both of Tenn.

[73] Assignee: CPS Industries, Franklin, Tenn.

[21] Appl. No.: 13,577

[22] Filed: Feb. 21, 1979

[51] Int. Cl.[3] ..... B29C 19/00; B32B 31/00; B05C 3/02; B05D 5/10

[52] U.S. Cl. ..... 156/180; 156/296; 156/313; 156/242; 427/208.2; 427/208; 427/366; 118/405; 118/424; 428/396; 428/375; 156/205; 156/176; 156/178

[58] Field of Search ..... 156/244.11, 296, 313, 156/180, 176, 178; 427/207 R, 207 A, 208, 434 B, 358, 365, 366; 118/405, 424; 428/375, 361, 349, 395, 396, 394

[56] References Cited

U.S. PATENT DOCUMENTS

| | | | |
|---|---|---|---|
| 2,156,923 | 5/1939 | Picard | 427/175 |
| 2,206,899 | 7/1940 | Kellgren | 427/208 |
| 2,514,187 | 7/1950 | Bosomworth | 427/175 |
| 3,058,151 | 10/1962 | Gonsalves | 427/434 |

FOREIGN PATENT DOCUMENTS

| | | | |
|---|---|---|---|
| 600993 | 7/1960 | Canada | 427/365 |
| 847849 | 7/1970 | Canada . | |

*Primary Examiner*—John T. Goolkasian
*Assistant Examiner*—L. Falasco
*Attorney, Agent, or Firm*—Thomas H. Murray; Clifford A. Poff

[57] ABSTRACT

A reinforcement seal and tear tape or line is produced by a method wherein selected fibrous yarn is passed into a bath of hot-melt adhesive maintained at a desired temperature. The yarn is spread laterally and tensioned within the bath to cause the adhesive to penetrate and surround the fibrous yarn. The adhesive adhered to the yarn is extruded within the bath to controllably reduce the amount and cross-sectional shape of the adhesive coating on the yarn by contact with rollers, one of which is submerged in the adhesive bath or a die partly submerged in the adhesive bath. The yarn with an extruded adhesive coating thereon is then cooled by passing through a refrigerated cooling chamber after which the adhesive coating is formed into a desired shape by contact with a chilled-forming surface of superimposed rollers. Reels are then used to coil the coated yarn into spools.

10 Claims, 1 Drawing Figure

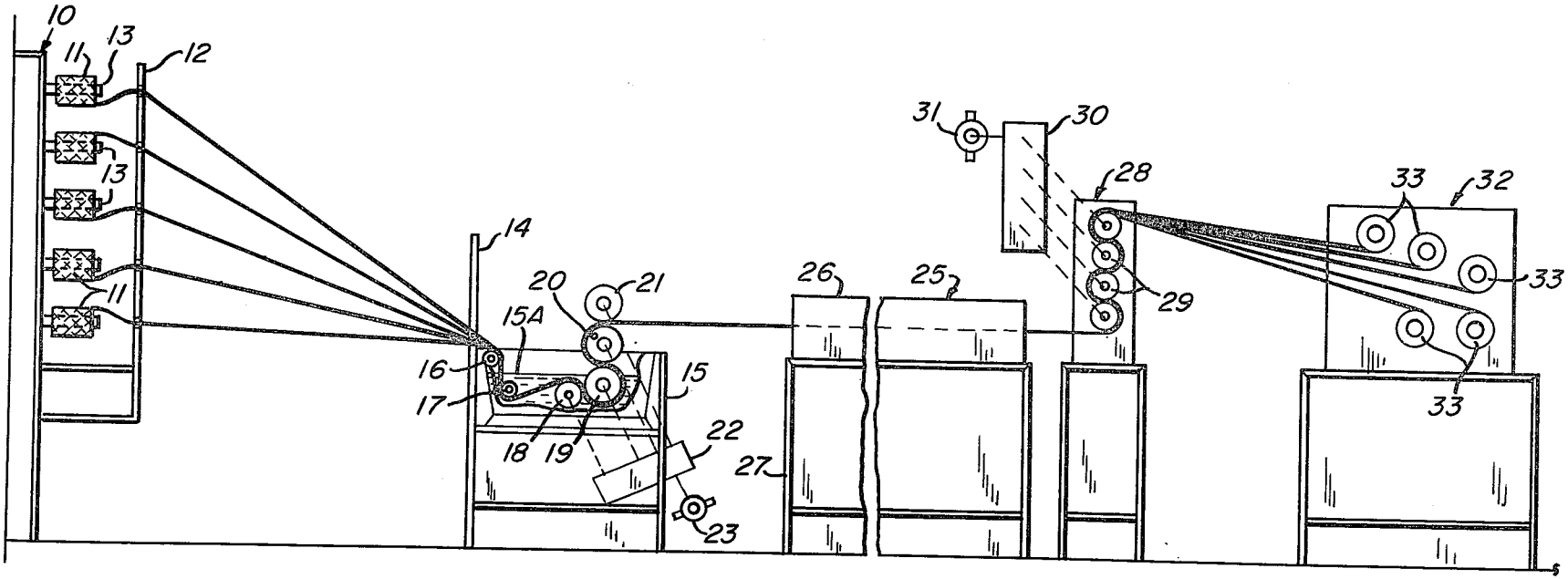
10
11
12
13
13
11
14
15
16
17
18
19
20
21
22
23
25
26
27
28
29
30
31
32
33
33
33

METHOD FOR PRODUCING TEAR TAPE AND SEAL AND TEAR LINE FOR PACKAGING

BACKGROUND OF THE INVENTION

This invention relates to a method to produce tear reinforcement and seal line or tape for packaging essentially comprised of a fibrous yarn and a coating thereon of hot-melt adhesive which is compacted before solidification of the adhesive and formed after solidification into a desired final shape for use as a reinforcing tape or line in a packaging container as well as a package-opening device.

While not so limited, the present invention is particularly useful for producing a strand-like tape for use as a package seal or reinforcement element and/or, if desired, a tear element for opening a packaging container. Corrugated cartons used for packaging are cumbersome to reinforce from the standpoint of both expense and effectiveness. Stressed areas in a corrugated carton are usually reinforced by using heavy liners or multi-wall construction. Not only are the stressed areas reinforced but also the entire carton. However, unnecessary bulk and weight are added to the container. Such measures for reinforcing stressed areas of a carton also increase the coat without significant improvement to wet strength, bulge resistance, durability and loading strength.

To overcome these shortcomings and disadvantages, the present invention provides a method for producing a tape or line for packaging which dispenses with the need for expensive paper stock by utilizing high tensile strength filaments and hot-melt adhesive readily useful to add reinforcement to a corrugated container or the like either during the manufacturing process for the container or after manufacturing by the simple addition of heat to activate the thermoplastic adhesive for bonding the tape or line at the desired site. In this way, reinforcement is readily achieved at critical stress points to adapt the carton for specific needs. Moreover, package seal line is easily added and the same line may be used as reinforcement to absorb and spread compressive loads, shocks and stresses to enable the use of lower-weight liners without reducing the performance of the carton.

The coating method of the present invention is characterized by a high production capacity and capability or producing tear tape and/or seal and tear line essentially comprised of a compacted and shaped adhesive coating tightly adhered to fibrous yarn. Because of the nature of the product, fibrous yarn must be fed through a coating line at an economically feasible speed. However, the speed at which the coating process is carried out is dependent on variables including the type of yarn, material of the yarn and properties of the selected adhesive. The present invention is based on the discovery that the yarn must be preconditioned with respect to tension and cross-sectional shape immediately before coating with adhesive and within the very short residence time of the yarn in a bath of hot-melt adhesive. Absent such preconditioning of the yarn, there is an immediate stripping of any adhered coating in the bath because of the speed at which the yarn is pulled through the bath.

SUMMARY OF THE INVENTION

It is an object of the present invention to provide a method for producing tear tape and/or seal and reinforcement or tear line for packaging wherein the tape or line is essentially comprised of fibrous yarn with an extruded coating of hot-melt adhesive which is compacted and shaped for use as a package seal line, a package tear tape and/or reinforcement for packaging materials.

More particularly, the method of the present invention is characterized by the steps for producing a package reinforcement seal line essentially including selecting a fibrous yarn having a desired denier and tensile strength, passing the selected yarn into a bath of hot-melt adhesive maintained at a desired temperature essentially above the liquidus temperature of the adhesive, laterally spreading the yarn under a controlled tension within the bath of hot-melt adhesive to cause the adhesive to penetrate and surround the fibrous yarn, extruding a coating of adhesive onto the yarn in the bath, cooling the yarn with the extruded adhesive coating thereon, forming the cooled adhesive coating on the yarn into a desired shape, and coiling the adhesive-coated yarn.

The method of the present invention is further characterized wherein the step of extruding includes contacting adhesive on the yarn within a die or grooved surface of at least one roller while at least partly submerged in the bath of adhesive. In the illustrated embodiment of apparatus to carry out the step of extruding, a plurality of pass openings in the nips of contacting rollers are arranged so that at least one of the nips is above the surface of adhesive in the bath. The coating of adhesive is compacted while passed between the rollers while coupled to temperature control means. Cooling of the extruded adhesive coating on the yarn is preferably carried out in a refrigerated cooling chamber. The cooled adhesive coated yarn is preferably formed into a desired cross-sectional shape by the passage through openings at the nips between grooved superimposed rollers having cooling means associated therewith to chill the roller face surfaces.

These features and advantages of the present invention as well as others will be more fully understood when the following description is read in light of the accompanying drawing wherein there is illustrated one embodiment of apparatus to carry out the method of the present invention.

As shown in the drawing, a creel 10 is used to payout a plurality of filaments of yarn from spools 11 at vertically spaced-apart locations through openings in a plate member 12. The creel includes the usual, well-known post member 13 extending horizontally and supporting the spools of yarn. Yarn suitable for use in the method or the present invention is polyester yarn with a denier and tensile strength selected to meet the required tensile strength of the package tape or line. As well be described hereinafter, the yarn is coated with hot-melt adhesive, however such coating does not materially add to the tensile strength per se but achieves a central function of adhering the package tape or line to a container or the like at the desired site. The tensile strength of yarn suitable for the intended result may be as low as 19 pounds per square inch and as high as 120 pounds per square inch.

In the drawing, the yarn from five spools thereof is drawn through vertically-spaced openings in plate 12 and fed under a nominal tension to a guide plate 14 having horizontally-spaced yarn receiving openings that transpose the strands of yarn into horizontally-spaced entry sites above a bath of hot-melt adhesive in a tank 15. The adhesive in tank 15 is maintained above the liquidus temperature thereof by heating elements submerged and/or embedded within the walls of the tank. The heating elements are coupled to a controlled power supply in a manner which is per se well known in the art to maintain the adhesive bath at a desired temperature. The bath temperature is dependent upon the particular adhesive with a softening point usually within the range of 98° F. to 463° F., but typically at 250° F. A suitable adhesive to carry out the method of the present invention is currently supplied and available to the industry by Eastman Chemical Products Inc. and Amsco Adhesives Division of Union Oil of California.

While a nominal tension is maintained in the yarn passed from plate 11 to plate 14, a controlled tension is maintained in the yarn during its passage within the bath of hot-melt adhesive. Moreover, the yarn is subjected to further preconditioning at the initial entry site into the bath by contact with a guide roller 16 above the bath and a spreading roller 17 submerged in the bath. As the yarn contacts an arcuate segment of the roller 17, the convex surface provided thereby is chosen to open up the fibers of the yarn to facilitate penetration of adhesive. Various devices such as dies may be used to achieve yarn preconditioning including a controlled tension. As shown in the drawing, three nips are formed by four roller members 18, 19, 20 and 21 with aligned grooves along the face surfaces of at least rollers 18, 19 and 20 but preferably each of these rollers. Tension is maintained on the yarn by coupling the rollers to a suitable drive 22 which is, in turn, connected to a motor 23 having a speed controller to control the peripheral speed of the rollers and thereby control the tension imposed on the yarn. By maintaining the tension on the yarn at a desired level, typically within the range of 2.5 pounds to 3.5 pounds, complete contact and effective penetration of the adhesive with the fibrous structure of the yarn are achieved for high productive speed of operation. Tensioning of a specific poundage on the fibrous yarn facilitates complete penetration of adhesive throughout the yarn fibers. In a typical coating operation, increasing the velocity of the yarn through the bath will cause less adhesive penetration. Regulation of the tension by an indirect relation to the operation speed allows and makes possible complete penetration regardless of machine speed. For example: 3.02 pounds tension is necessary at running speeds of 200'/minute per yarn strand while at speeds of 300 to 400'/minute, a tension of 2.77 pounds is necessary. This tension change and speed change is accomplished by using a speed controller coupled to the machine via mechanical, if desired, and/or electrical connections. When a die or rollers 18–21 are used in the tank, the adhesive coating on the yarn is passed through either the opening in the die or through the grooves of the rollers to control the shape and the adhesive content to the coating on the yarn. The temperature of the rollers or dies is controlled by the flow of a heating or cooling liquid along internal passageways in a manner which is per se well known. The adhesive is compacted to an increased density whereby there is an extruding of the coating onto each strand of yarn passing from tank 15. The nip formed by rollers 19 and 20 is above the surface 15A of the adhesive bath while the nip formed by rollers 18 and 19 is submerged within the bath. As the strands pass from the bath around roller 21, the coating of adhesive thereon is in a semisolidified state and subjected to further extruding by the nip formed by rollers 20 and 21. Thereafter, the coating on the strands undergoes chilling within a refrigerated cooling chamber 25. Chamber 25 is suitably in the form of a tunnel formed by a hood 26 supported on a base 27 used to carry refrigeration units for delivery of cooling air into the hood. The adhesive coating on the yarn is solidified in cooling chamber 25 and discharged to a chilling and forming station 28 where a stack of rollers 29 is arranged one above the other with horizontal axes of rotation. Four rollers 29 are shown each driven by a shaft coupled to a gear drive 30 which is, in turn, coupled to a motor 31. The adhesive-coated yarn passes to and fro between the nips formed by contacting rollers. The speed at which the rollers 29 rotate in relation to the speed at which rollers 18 and 21 rotate is controlled by the operation of motors 23 and 31 and is determinative of the delivery tension imposed on the yarn passing from the bath of hot-melt adhesive. A forward or upstream tension is determined and controlled by a nominal tension imposed on the yarn while passing between plates 11 and 14 as well as between rollers 16, 17 and 18. In this way, the tension on the yarn while passing through the bath of hot-melt adhesive is set and controlled so that the adhesive will penetrate and surround the fibrous structure of the yarn.

Returning now to the chilling and forming station 28, the rollers 29 may, if desired, have grooved surfaces along their faces thereof to form the cooled adhesive coating on the yarn into a desired shape. The coating on the yarn upon contact with the rollers is chilled by a substantial reduction to the temperature of the coating since the coating does retain residual heat at the discharge side of the refrigerated cooling chamber 25. If desired, the rollers 29 may be contructed so that their body portions join together the individual strands of coated yarn to form a single tape or strand and thereby provide a package seal strip having a desired width. When so joined, the package seal strip takes the form of a tape comprised of laterally-spaced strands of yarn joined by the mutual adherence of the coating thereon.

Upon discharge from the chilling and forming station 28, the individual strands of yarn with the hot-melt adhesive coating thereon or a single web of adjoined strands, as the case may be, are fed to a coiling station 32 where a plurality of winders 33 is coupled to a suitable drive to coil the adhesive-coated yarn. When individual strands of yarn with the hot-melt adhesive coating thereon are fed to the coiling station, individual coilers form the strands into spools for convenient handling and shipping.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A method to produce line or tape for packaging or the like including the steps of:

selecting a fibrous yarn having a desired denier and tensile strength, passing the selected yarn into a bath of hot-melt adhesive maintained at a desired temperature essentially above the liduidus temperature of the adhesive, laterally spreading the yarn under a controlled tension within the bath of hot-melt adhesive to cause the adhesive to penetrate and surround the fibrous yarn, thereafter extruding a coating of adhesive onto yarn in the bath, passing the adhesive-coated yarn from the bath, cooling the extruded coating of adhesive on the yarn, forming the cooled adhesive coating on the yarn into a desired shape, and coiling the adhesive-coated yarn.

2. The method according to claim 1 wherein said step of extruding includes compacting adhesive onto the yarn while at least partly submerged in the bath of adhesive.

3. The method according to claim 2 wherein said step of extruding further includes using a temperature controlled surface to compact adhesive on the yarn.

4. The method according to claim 1 wherein said step of laterally spreading includes contacting the yarn in said bath with the convex surface of a roller.

5. The method according to claim 1 wherein said step of forming includes passing the adhesive-coated yarn between a nips of rollers.

6. The method according to claim 1 wherein said step of cooling includes passing yarn with compacted adhesive thereon through a refrigerated cooling chamber.

7. The method according to claim 1 wherein said step of forming includes adjoining adhesive-coated yarn by contact between the adhesive coating on the yarn.

8. The method according to claim 1 wherein said step of extruding includes passing yarn about an arcuate segment and through an opening at the nip of grooved rollers while at least one of which is at least partly submerged in said bath of hot-melt adhesive.

9. The method according to claim 1 wherein said step of extruding includes passing yarn through a die while at least partly submerged in said bath of hot-melt adhesive.

10. The method according to claim 1 including the further step of guiding the yarn into said bath of hot-melt adhesive.

* * * * *